US005220167A

United States Patent [19]

Brown et al.

[11] Patent Number: 5,220,167

[45] Date of Patent: Jun. 15, 1993

[54] MULTIPLE ION MULTIPLIER DETECTOR FOR USE IN A MASS SPECTROMETER

[75] Inventors: Louis Brown, Washington, D.C.; Richard W. Carlson, Kensington; Steven B. Shirey, Chevy Chase, both of Md.

[73] Assignee: Carnegie Institution of Washington, Washington, D.C.

[21] Appl. No.: 766,726

[22] Filed: Sep. 27, 1991

[51] Int. Cl.[5] ..... H01J 49/26

[52] U.S. Cl. ..... 250/281

[58] Field of Search ..... 250/299, 298, 296, 294, 250/281, 283; 313/103 R

[56] References Cited

U.S. PATENT DOCUMENTS

| | | | |
|---|---|---|---|
| 3,080,754 | 3/1963 | Johnson | 250/283 |
| 3,517,191 | 6/1970 | Liebl | 250/296 |
| 3,522,428 | 8/1970 | Powers | 250/299 |
| 3,898,456 | 8/1975 | Dietz | 250/299 |
| 4,174,479 | 11/1979 | Tuithof et al. | 250/292 |
| 4,423,324 | 12/1983 | Stafford | 250/281 |
| 4,595,835 | 6/1986 | Boulin et al. | 250/288 |

OTHER PUBLICATIONS

The New Encyclopaedia Britannica, vol. 13, 15th Edition, by Encyclopaedia Britannica, Inc. 1988, "Mass Spectroscopy", pp. 599-604.

Abstract of Talk, Published Sep. 27, 1990, 1 page.

Kel'man et al., "Prism Mass Spectrometer with Energy Focusing", Soviet Physics—Technical Physics, vol. 16, No. 1, pp. 130-135.

Kel'man et al., "Mass Spectrometer with Electrostatic and Magnetic Prisms", Soviet Physics-Doklady, vol. 14, No. 2, Aug. 1969, pp. 155-157.

Kuzema et al., "Radial Focusing of An Ion Beam in a Magnetic Analyzer with an Inhomogeneous Field and an Electrostatic Lens", Sov. Phys. Tech. Phys. 22(11), Nov. 1977, pp. 1371-1373.

Louter et al., "Ion Optics of a Tandem Mass Spectrometer with Variable Dispersion and Simultaneous Detection: Second Stage", Nuclear Instruments and Methods 187 (1981) pp. 137-142.

*Primary Examiner*—Jack I. Berman

*Attorney, Agent, or Firm*—Cushman Darby & Cushman

[57] ABSTRACT

A mass spectrometer for ion ratio detection. The ions are produced and initially focussed in the conventional way. After focusing, the ion beams are refocused by a magnifying focusing assembly which is located past the focal plane. The magnifying lens magnifies the beam spacing, and the focal plane. A series of staggered conversion dynode assemblies, each of which have a side entry that reflects the ions toward an electron multiplier, is located along the magnified focal plane. Each assembly receives one of the ion beams, and the others pass to the subsequent assemblies. The space between the bottom of each assembly and the slit into which the ion beam enters, must therefore be smaller than a spacing between beams.

20 Claims, 5 Drawing Sheets

MULTIPLE ION MULTIPLIER DETECTOR FOR USE IN A MASS SPECTROMETER

STATEMENT AS TO RIGHTS UNDER FEDERALLY SPONSORED RESEARCH DEVELOPMENT

The present invention was partially funded by National Science Foundation Grant No. EAR-87-20836.

FIELD OF THE INVENTION

The present invention relates to a special focusing scheme and ion multiplier detector for a mass spectrometer to be used in geochronology. More specifically, the present invention defines a technique of using ion optical magnification to increase the spacing between adjacent beams of a mass spectrometer that allows a multiple detector array for the simultaneous detection of the multiple beams.

BACKGROUND OF THE INVENTION

Geochronology is the study of dating of rocks and has been extensively used for dating earth crust and mantle specimens, for example. One way in which this has been done, and the way done according to the preferred embodiment, is to determine a ratio between the 187 isotopes of rhenium and osmium (herein Rh and Os). Rh-187 decays to Os-187 with a half life of 50 billion years. The ratio between the amount of Rh-187 and Os-187 has been used for dating such rocks. Other materials which decay in this way include Ur→Pb, Sm→Nd and Rb→Sr. A brief description of the way this is done will be provided herein.

One of the most accurate ways of determining the amount of Rh and Os present is by using a mass spectrometer. There are many kinds of mass spectrometers, but the two most common in use include a first type which determines a mass of the ion, and a second type which determines a ratio between amount of one isotope to another. The first type mass spectrometer can determine a specific mass to a high accuracy. The second type of mass spectrometer, and the type which is used in the environment of the present invention, provides a very accurate ratio of masses present between two or more isotopes.

The Rh/Os ratio is obtained is by taking a sample to be analyzed and pulverizing it in a way known in the art. This special pulverization causes the sample to break along crystal boundaries so that contiguous crystal amounts are obtained. The ratios of Rh to Os within similar kinds of contiguous crystals will accurately date the age of the rock. The crystal groups are then processed in a way known in the art to separate the Rh and the Os from the rest of the rock. This is beyond the scope of this disclosure. At that point, the amount of Rh and the amount of Os will be determined.

The Rh-187 amount is determined by taking the sample of Rh and diluting it with a sample of pure Rh-185. Such samples are available from, for instance, Oak Ridge Laboratory. The combined sample of Rh-187/Rh-185 is run through the ratio-type mass spectrometer which provides the amounts of 187 relative to 185. Since the amount of Rh-185 which has been added is known, the amount of Rh-187 can then be determined. Similarly, the Os-187 is determined. Rh-187 is radioactive. The sample of Os will, itself, have a number of peaks and the ratio between the peaks which are normally there, and the 187 peak, is used to determine the amount of Os-187. Once the amount of Rh-187 and Os-187 are determined, they are plotted as a function of one another, and the slope of this line provides the age of the sample from which it was taken.

In order to accurately assess the amount of Rh or Os, a ratio between at least two sample beams, each representing an amount of one isotope, must be taken. The problem in the prior art is that for heavy elements, such as Rh and Os, the separation between the beams becomes smaller. The beam separation at the exit of a typical spectrometer used in this way is about 1.4 mm.

The amplitude or amount of these ion beams can be detected in two ways. The first technique of detection of such beams is by using a so-called Faraday cup. A typical Faraday cup is a metal cup with razor blade-like structures defining an entrance into the cup. A wire is attached to each cup, and measures the current caused by the ions or electrons which enter it.

A limitation on the use of a Faraday cup is that they can only register relatively large amounts of current. Faraday cups cannot operate effectively with a current of less than, for example, $10^{-12}$ amperes.

Any current less than $10^{-12}$ amperes requires operation using a so-called electron multiplier. An electron multiplier is conceptually a series of electrodes, each of which produces a plurality of electrons for each electron or ion which impinges thereon. The subsequent electrodes are at lower potential than the earlier electrodes and therefore the electrons impinging on the device are continually increased until the output of the electron multiplier. Electron multipliers of so-called semiconductor glass have also been made.

Faraday cups can be made very small, and in fact, small enough to obtain information from beams split on the order of magnitude of 1.4 mm, such as from Rh and 187 Os. However, electron multipliers are typically required to obtain readings from a small sample of heavy material (e.g. 187). Even the smallest electron multipliers, however, are typically at least an inch in size and have their entrance slit in their center so that they cannot be used to resolve closely adjacent beams.

Accordingly, when multiple beams with small separations that require an electron multiplier have been used in the prior art, the electron multiplier has been moved from beam to beam. Typically, one beam is measured for ten seconds and the other beam is subsequently measured for the next ten seconds. This provides a good approximation of the ratio between the beams, but the problem is that the beam is never totally stable with time and therefore the ratio is inaccurate by whatever instability exists. However, there has been no way known to obviate this problem. This procedure is also wasteful of sample, which is frequently very small, as ions can be registered only when a beam is directed into a detector.

The present invention obviates this problem in a way that is nowhere taught or suggested by the prior art, and discussed in detail herein.

SUMMARY OF THE INVENTION

The present invention defines a mass spectrometer system that obviates these problems. A first aspect of the present invention includes ion initial focusing means for obtaining ions indicative of the sample to be measured and focusing these ions to a first focal plane. This first focal plane is the place where detection is usually done in the prior art. However, this first aspect of the invention places an electrostatic lens means beyond the first focal plane for magnifying and refocusing the ions such that a separation between the ion beams is larger than a corresponding separation at the first focal plane.

A second aspect of the invention relates to the detectors which are located at this second magnified focal plane. These detectors include structures with side walls and a bottom wall one of the side walls having an entry port for the ions near the bottom thereof. The ion beam enters through this entry port and strikes a dynode which frees electrons that are attracted towards an electron multiplier. The advantage of this structure is that since the ion beam enters from a lower side thereof, the adjacent ion beam can pass the first detector and be detected by a subsequent second detector.

The spacing of the detectors/entry ports must be such that the location where the ion beam enters is a location that allows all adjacent ion beams to pass without interference, and more specifically in one aspect of the invention a space between a bottom of said bottom wall and said entry port is smaller than a spacing between said ion beams so that adjacent ion beams pass below said bottom of said bottom wall.

The present invention also contemplates a method for accomplishing the above.

DESCRIPTION OF THE DRAWINGS

These and other aspects will now be discussed in detail with reference to the accompanying drawings wherein.

DESCRIPTION OF THE PREFERRED EMBODIMENTS

Figure 1:
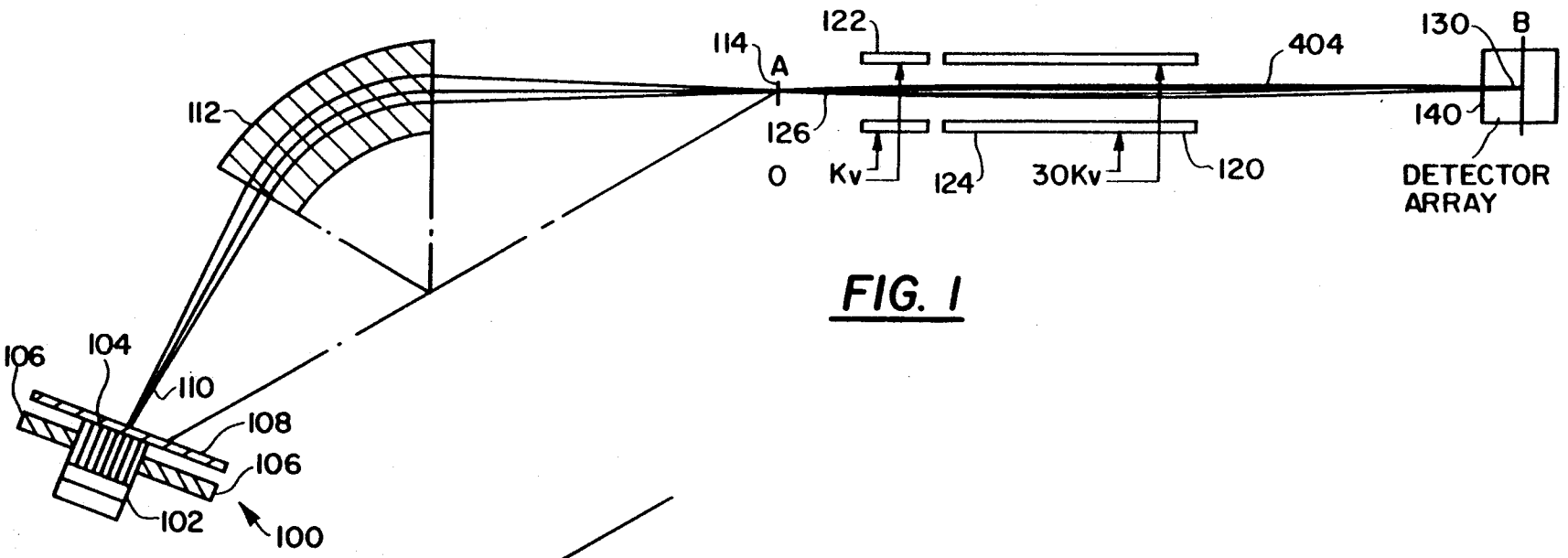
FIG. 1 shows a block diagram representation of the mass spectrometer including detector of the present invention.

FIG. 1 shows an overall schematic diagram of the mass spectrometer system forming the present invention. The ion source is shown generally as 100, and can comprise any known source of ions although in the preferred embodiment, this source of ions is a Ta filament which has been cleaned and on which the ion sample to be measured is deposited. The Ta filament 102 is heated by an electric current passed therethrough, to emit an ion beam shown as 104. These ions are attracted by an attracting electrode 106 which is at a lower potential than the potential of the filament 102. These attracting electrodes tend to attract the ions 104 and impart a momentum to them which they retain.

The ion beam 104 is not focused, but is essentially truncated by a slit electrode 108 which allows only the slit ions 110 to pass. The truncated ions 110 are then placed in the beam of a very strong magnet 112, in the preferred embodiment a 9 inch radius magnetic sector, which makes the ions curve due to the bending nature of the magnetic field. Because of the spread of the ions and the bending nature of the magnetic field caused by the magnet 112, the ions are caused to come to a focus along a first focal plane at 114. The way in which these magnets focus the ions is well known in the art and will not be reiterated here.

Figure 2B:
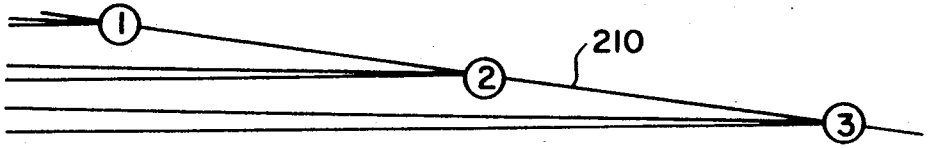
FIG. 2B shows a blown-up drawing of the respective ion beams in the focal plane at the location referenced by the letter B in FIG. 1.
Figure 2A:
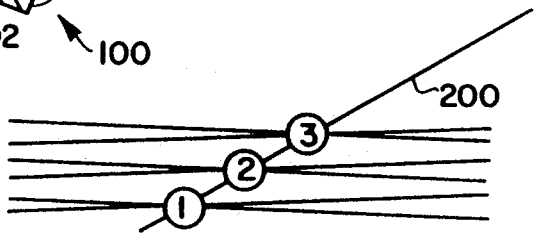
FIG. 2A shows a blown up view of the ion beams in the focal plane at the location referenced by the letter A in FIG. 1.

A detail of the focal plane showing the way in which the ions come to a focus at 114 is depicted in FIG. 2A. The multiple ion beams from the ion source (each ion beam representing one of the particular ion masses), come to focus at different locations, due to their different masses. These locations, however, are along a first focal plane 200 which is slanted with respect to the axis defined along the path of the ion beams. The ion beams are labeled as 1, 2 and 3 in FIG. 1, although it should be understood that only two beams could be present, or that more than three beams could be present. The three-beam feature is preferred for the present invention since it enables calculation of components of both rhenium and osmium.

The focus point 114 is the point where normally the Faraday cups and/or electron multipliers will be located. However, according to the most preferred embodiment of the present invention, an accelerating lens is located approximately 4.5 inches past the focus point 114. The lens is provided for the purpose of magnifying the beam, with the preferred beam magnification being between 3 and 3.5.

Figure 4:
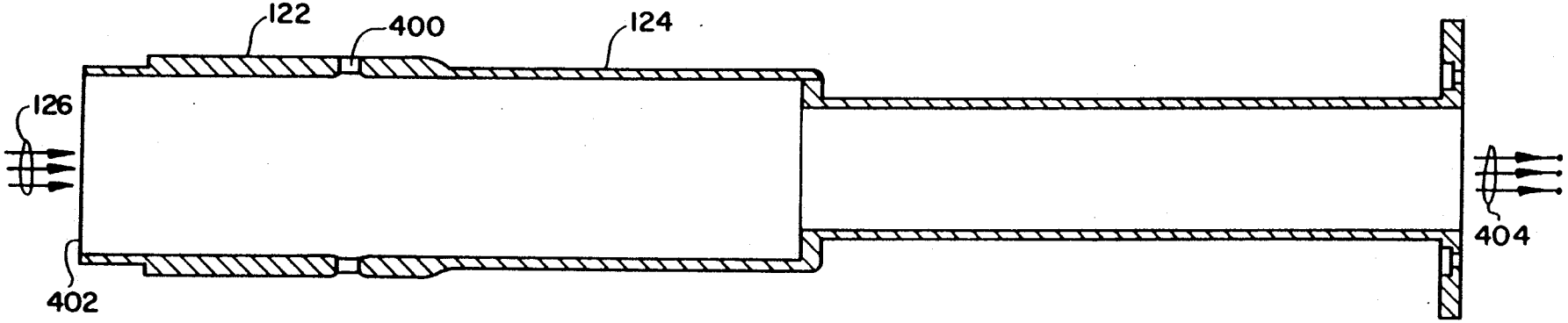
FIG. 4 shows a detailed layout of the lens used according to the present invention.

The design of electrostatic lenses is well known in the art, and can proceed according to the teaching in any of a plurality of well known textbooks on electrostatic lens design. Different magnifications can be easily obtained and all of these are no more than cook book plug-ins for one of skill in the art. However, the electrostatic lens comprising the best mode of the present invention is described in detail with reference to FIG. 4. Of course it should be understood that any other kind of lenses besides accelerating lenses could be used—so long as they have the desired effect of magnifying the spacing between the ion beams at the second focal point, and all of these lenses are herewith intended to be encompassed by the term lens or lens means in this specification.

The lens 120 comprises two parts, a first part 122 which is at zero potential, and a second part 124 which is maintained at a potential of 30 kV. A one-quarter inch gap 400 separates the two parts. The extent of the lens are shown in detail in FIG. 4. Focussing takes place in the region near the gap. The first lens part 122 is approximately 3.2 inches long, and of the 2.5 inch diameter, the second lens part approximately 17 inches long, with a wide diameter portion (2.5 inches) being approximately 8 inches long and a narrow diameter portion which is approximately 9 inches long. The beams 126 entering the lens at its entrance 402 are accelerated by the lens, and leave as magnified beams 404. Everything about these exiting beams is magnified, including their volume, velocity and spacing. The lens also has a focusing component, so that the magnifying beams 404 are focused at a second focus point 130.

A detail of the magnified focal plane B is shown in FIG. 2B, and it shows the same three beams as are shown in FIG. 2A. The direction of the second magnified focal plane is reversed from the direction of the first focal plane. The second focal plane 210, along with the beams are focused, allows about three times as much separation between the beams as those shown in FIG. 2A.

Figure 3:
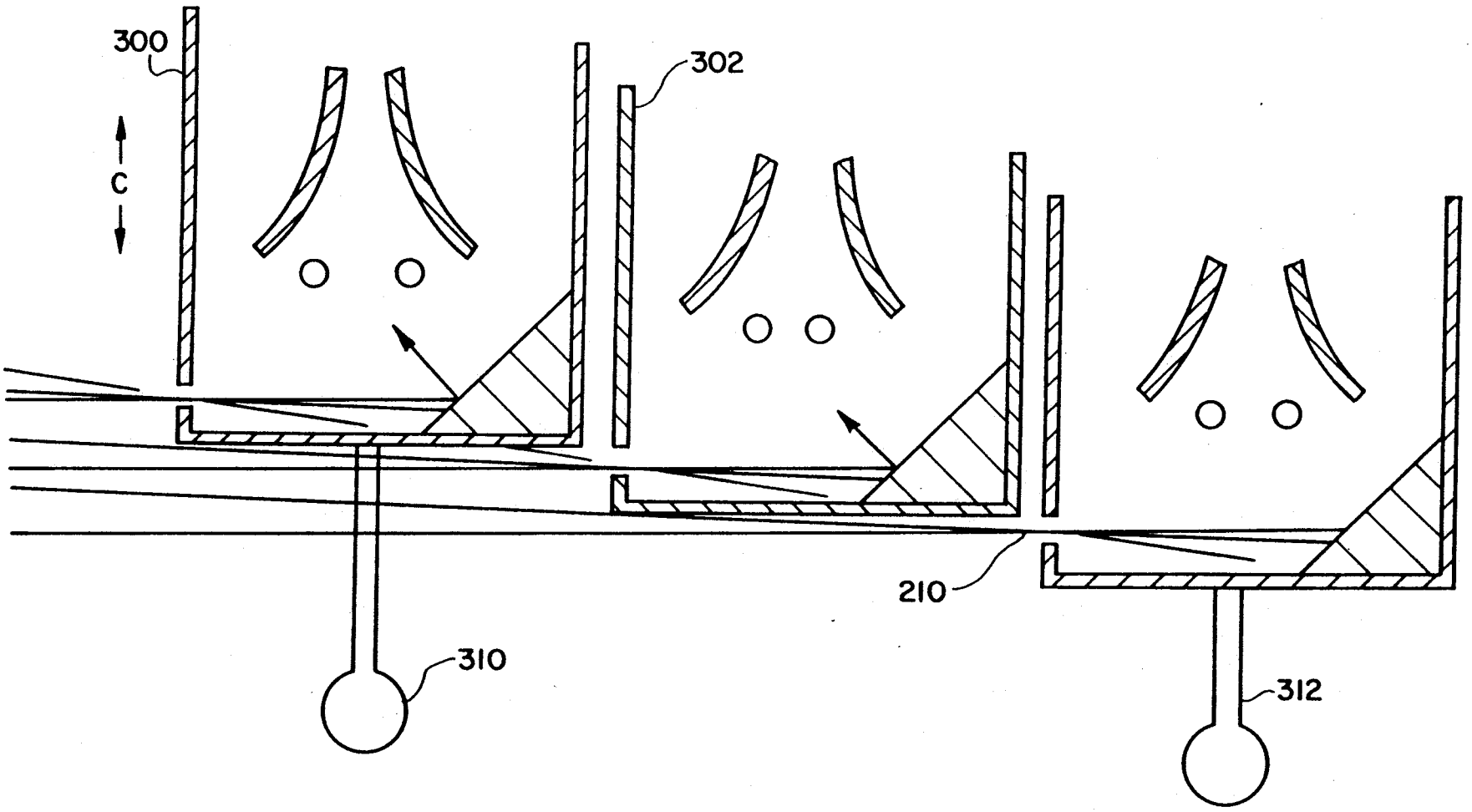
FIG. 3 shows the detectors of the present invention and their placement in their respective locations along the focal plane.

FIG. 3 shows a detailed blow-up of the detector array 140 shown along the focal plane 210 of FIG. 2B. The detector array comprises three detector elements 300, 302 and 304. Each of these detector elements is a conversion-dynode electron-multiplier which has an ion beam entry point on its side-most portion at a bottom thereof. The first element receives the top beam, and the rest of the beams pass under it. In order to allow this, a space between a bottom of said bottom wall of the electron multiplier and the entry port must be smaller than a spacing between said ion beams so that a second ion beam, adjacent to said first ion beam passes below said bottom of said bottom wall. More generally, however, the location where the ion beam enters must be a location that allows all adjacent ion beams to pass without interference. Further detail on the structure of each of these systems is provided with reference to FIGS. 5 and 6.

Figure 5:
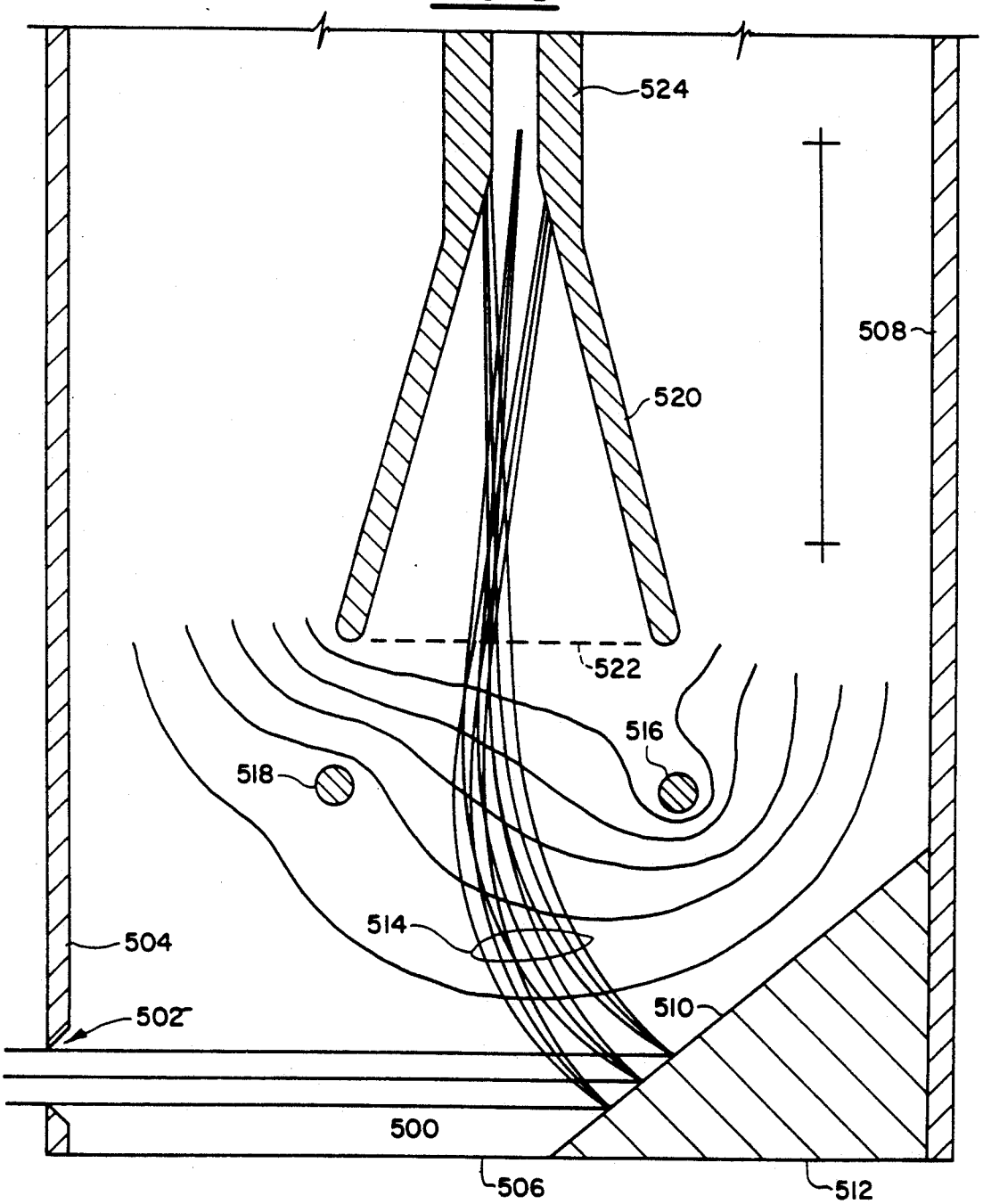
FIGS. 5 and 6 show detailed layouts of the conversion dynode electron multiplier device used according to the present invention.

The detector is shown in detail in FIG. 5, where a particular ion path 500 enters through a slit 502 in the entry wall 504. The walls of the electron multiplier 504, 506 and 508 are preferably formed of stainless steel or the like with wall 506 being very thin, about 0.OO1 inch. A conversion dynode 510, which can be as simple as a flat sheet of aluminum foil, is placed in one corner 510 of the device and forms approximately a 40° angle with respect to the bottom wall 506. The ions strike the conversion dynode, and free secondary electrons 514 are released indicative of amplitude of the ion strikes. Two auxiliary electrodes 516 and 518 are provided along the path of the electrons as focusing electrodes. The lines shown in FIG. 5 are equipotential lines showing the locations of the potentials formed by the electrodes. Auxiliary electrode 516 is biased at 1000 V and electrode 518 is biased at 165 V.

The electron multiplier 520 is of a continuous dynode type, and has a grid 522 at 1000 V and a collector 524 between which is biased at approximately 1500 V. The secondarily emitted electrons are attracted into the continuous dynode detector, where they are converted into an electric current in a similar way to that known in the art.

The view of FIG. 3 shows the middle electron multiplier assembly 302 fixed in position along the focal plane 210. Electron multiplier 300 is connected to first position adjusting device 310 and electron multiplier 304 is connected to second position adjusting device 312. These position adjusting devices are preferably micrometers which adjust the position of the electron multiplier assembly in the direction shown by arrow C to place it more precisely along the focal plane. A typical electron multiplier device (dynode 520) such as used according to the present invention is commercially available from the American company Detector Technology.

Figure 6:
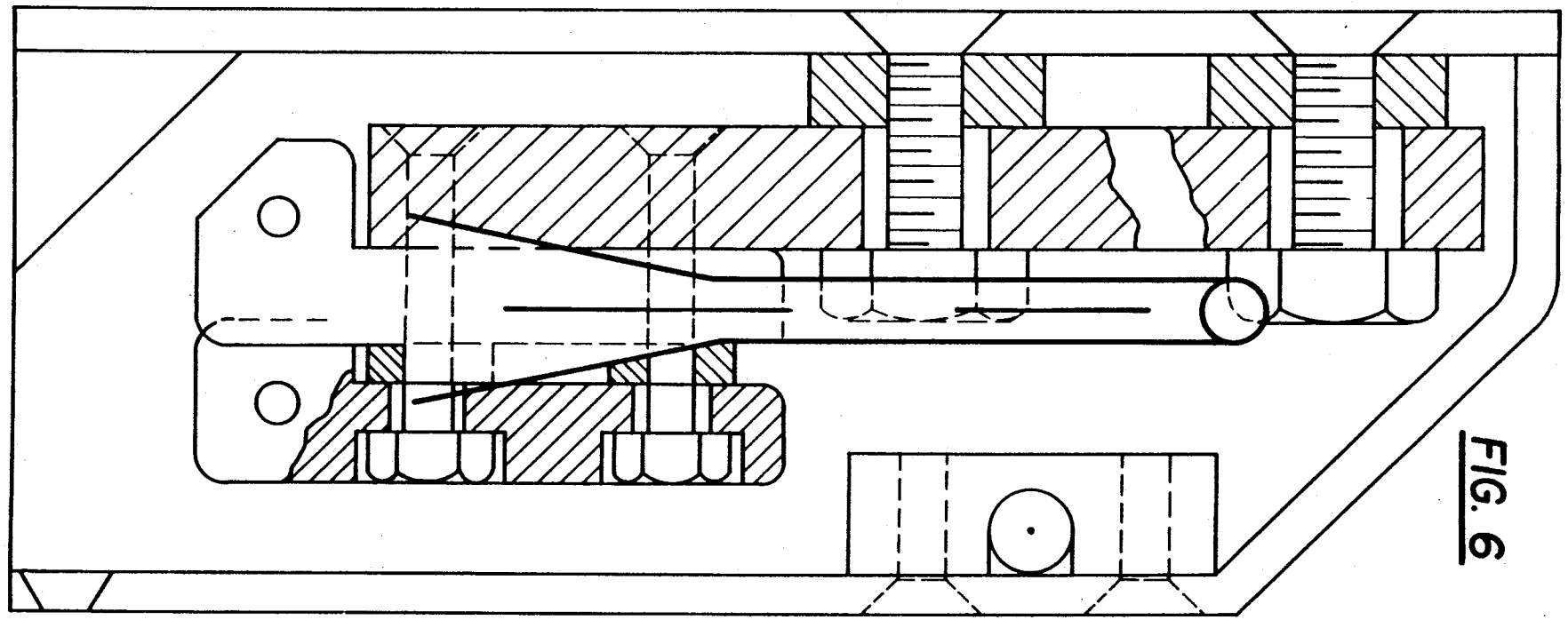

An assembly drawing of the continuous electron dynode of the present invention is shown in FIG. 6 which shows a scale drawing of the electron multiplier assembly. This shows that the slit which allows entry of electrons is approximately 1/16 inch at the ingress and approximately ⅛ of an inch at the egress. The internal distance from wall-to-wall is close to one inch, but the spot at which the ions strike the conversion dynode is approximately ⅜ of an inch from the edge. Both of the focusing electrodes are approximately ⅓ of an inch above the electron beam, and equally spaced between the walls. The distance from the electron beam to the grid is approximately ⅜ of an inch and the overall height from the grid to the collector is about 1.5 inches.

Although only a few embodiments have been described in detail above, those of skill in the art certainly understand that many modifications are possible in these preferred embodiments without departing from the advantageous teachings of the present invention. For instance, although a filament is described as being the ion source, of course the invention is not limited to such, and a pulsed sputter gun or laser could be used as the ion source. Alternate methods of focusing the ions from the ion source are also well known. The lens has been described in its preferred embodiment, but many other designs for this lens are possible, and these are well within the design parameters of those of skill in the art The preferred magnification is 3.5, but other magnifications are also possible.

The conversion dynode electron multiplier has been described as such, but a discrete dynode multiplier could also be used. The important thing about the multiplier structure is that beams enter from a lower portion thereof to permit adjacent multipliers to be located. Moreover, although the invention has been described as its preferred embodiment, being one for dating rocks using Rh and Os, it could of course be used with any mass spectrometer now known.

All such modifications are intended to be encompassed in the following claims.

What is claimed is:

1. A mass spectrometer system comprising:

ion initial focusing means, for obtaining ions indicative of a sample to be measured, and focusing said ions to a first focal plane;

lens means, located beyond said first focal plane, for magnifying and refocusing said ions to a second focal plane, such that a separation between first and second ion beams at said second focal plane is larger than a corresponding separation between said first and second ion beams at said first focal plane by an amount related to an amount of said magnifying, and such that a direction of said second focal plane is reversed from a direction of said first focal plane.

2. A system as in claim 1, wherein said ion source comprises a Ta filament on which is located said sample to be measured, and at least one electrode for accelerating ions emitted therefrom.

3. A system as in claim 2 further comprising a bending magnet for focusing ions from said plurality of electrodes to said first focal plane.

4. A system as in claim 1, further comprising multiple detectors along said second focal plane.

5. A system as in claim 4, wherein said multiple detectors are at least two electron multiplier structures, each of which receives an ion beam at an entry location that allows all adjacent ion beams to pass without interference.

6. A system as in claim 4, wherein each said detector includes:

a first detector device, located to receive said first ion beam, and including two side walls and a bottom wall, one of said side walls having an entry port for said ion beam near a bottom portion thereof, and having an electron multiplier spaced from said bottom wall, and means for directing electrons indicative of said ion beam toward said electron multiplier to be detected thereby, wherein a space between a bottom of said bottom wall and said entry port is smaller than a spacing between said ion beams so that said second ion beam adjacent to said first ion beam passes said bottom of said bottom wall; and a second detector, located to receive a second ion beam, located spaced from said first detector and slightly below it, and including two side walls and a bottom wall, one of said side walls having an entry port for said second ion beam near a bottom portion thereof, and having an electron multiplier spaced from said bottom wall, and means for directing electrons indicative of said ions toward said electron multiplier to be detected thereby.

7. A system as in claim 4, wherein said detectors each include an entry slit near a bottom-most portion thereof.

8. A system as in claim 7, wherein a first of said detectors receives a first beam through said entry slit, and a second ion beam passes beneath said first detector and to a second of said detectors.

9. A system as in claim 1, wherein said amount of said magnifying is 3–3.5.

10. A mass spectrometer system comprising:

ion initial focusing means, for obtaining ions indicative of a sample to be measured, and focusing said ions to a first focal plane;

lens means, located beyond said first focal plane, for magnifying and refocusing said ions to a second focal plane, such that a separation between first and second ion beams at said second focal plane is larger than a corresponding separation between said first and second ion beams at said first focal plane by an amount related to an amount of said magnifying, wherein said lens means is a lens which has two separated parts, a first part at zero potential and a second at high potential.

11. A mass spectrometer assembly comprising:

means for obtaining ions indicative of a sample to be measured, and focusing said ions to a focal plane along which each of a plurality of ions beams from said sample focus, each ion beam representative of a particular mass;

a first detector, located to receive a first ion beam indicative of a first mass of ions, and including two side walls and a bottom wall, one of said side walls having an entry port for said ions near a bottom portion thereof, and including an electron multiplier spaced from said bottom wall, and means for directing electrons indicative of said ions toward said electron multiplier to be detected thereby, wherein a space between a bottom of said bottom wall and said entry port is smaller than a spacing between said ion beams so that a second ion beam adjacent to said first ion beam passes below said bottom of said bottom wall;

a second detector, located to receive a second ion beam indicative of a second mass of ions, located on an other side of the other of said side walls of said first detector and slightly below said first detector, and including two side walls and a bottom wall which is slightly lower than said bottom wall of said first detector, one of said side walls having an entry port for said second ion beam near a bottom portion thereof, and having an electron multiplier spaced from said bottom wall, and means for directing electrons indicative of said ions from said second ion beam toward said electron multiplier to be detected thereby;

a third detector, located to receive a third ion beam indicative of a third mass of ions, located on an other side of the other of said side walls of said second detector and slightly below said second detector, and including two side walls and a bottom wall which is slightly lower than said bottom wall of said second detector, one of said side walls having an entry port for said third ion beam near a bottom portion thereof, and having an electron multiplier spaced from said bottom wall, and means for directing electrons indicative of said ions from said third ion beam toward said electron multiplier to be detected thereby; and positioning adjusting means for adjusting a fine position of at least one of said detectors;

wherein said obtaining means further comprises an electrostatic lens assembly, located beyond a first focal point, for magnifying and refocusing said ions to a second focal point, such that a separation between ion beams at said second focal point is larger than a corresponding separation between ion beams at said first focal point by an amount related to an amount of said magnifying, and such that a direction of said second focal plane is reversed from a direction of said first focal plane.

12. An assembly as in claim 11, wherein said means for directing electrons of said detector comprises a conversion dynode at 40° with respect to the horizontal.

13. An assembly as in claim 12, wherein said means for directing electrons of said detector further comprises at least one electrode to attract said electrons indicative of said ions theretowards.

14. An assembly as in claim 11, wherein said electrostatic lens assembly includes a lens which has two separated parts, a first part at zero potential and a second at high potential.

15. A mass spectrometer assembly comprising:

ion initial focusing means, for obtaining multiple ion beams indicative of a sample to be measured, each ion beam representing a particular mass component of said sample, and focusing said ion beams to a first focal plane;

an electrostatic lens assembly, located beyond said first focal plane, for magnifying and refocusing said ion beams to a second focal plane, such that a separation between ion beams at said second focal plane is larger than a corresponding separation between ion beams at said first focal plane by an amount related to an amount of said magnifying, wherein said electrostatic lens assembly includes a lens which has two separated parts, a first part at zero potential and a second at high potential; and means for detecting said ion beams at said second focal plane, including:

a first detector, located along said second focal plane to receive a first ion beam, and including at least two walls, one of which has an entry port for said first ion beam near a portion thereof where it meets the other, and having an electron multiplier spaced from said bottom wall, and means for directing electrons indicative of said first ion beam toward said electron multiplier to be detected thereby, wherein a space between said portion and said entry port is smaller than a spacing between said ion beams so that a second ion beam, adjacent to said first ion beam passes below said first detector;

a second detector, located along said second focal plane to receive said second ion beam which has passed said first detector, and including at least two walls, one of which has an entry port for said second ion beam near a portion thereof where it meets the other, and having an electron multiplier spaced from said bottom wall, and means for directing electrons indicative of said second ion beam toward said electron multiplier to be detected thereby, wherein a space between said portion and said entry port is smaller than a spacing between said ion beams so that a third ion beam, adjacent to said second ion beam, passes said second detector; and a third detector, located along said second focal plane to receive said third ion beam which has passed said second detector.

16. An assembly as in claim 15, wherein each of said detectors has said entry port in a side wall thereof, and wherein a space between a bottom of a bottom wall and said entry port is smaller than a spacing between said ion beams.

17. An assembly as in claim 15, further comprising a conversion dynode, located in a path of the incoming beam after entry of said incoming beam through said entry port, and facing in a direction so as to emit electrons indicative of said beam in a direction away from as bottom wall.

18. A method of conducting mass spectroscopy of a sample, comprising the steps of:

obtaining multiple ion beams indicative of a sample to be measured, each ion beam representing a particular mass component of said sample;

focusing said ion beams to a first focal plane;

magnifying and refocusing said ion beams from a point beyond said first focal plane to a second focal plane, such that a separation between ion beams at said second focal plane is larger than a corresponding separation between ion beams at said first focal plane by an amount related to an amount of said magnifying and such that a direction of said second focal plane is reversed from a direction of said first focal plane; and detecting said ion beams at said second focal plane.

19. A method as in claim 18, wherein said detecting step includes:

locating a first detector along said second focal plane to receive a first ion beam, and receiving said first ion beam in an inert port thereof, near a portion thereof where a side wall meets a bottom wall thereof;

directing electrons indicative of said first ion beam toward an electron multiplier to be detected thereby, wherein a space between said portion and said entry port is smaller than a spacing between said ion beams so that a second ion beam, adjacent to said first ion beam passes below said first detector; and locating a second detector along said second focal plane to receive said second ion beam which has passed said first detector.

20. A method as in claim 19, further comprising the step of locating a conversion dynode in a path of the incoming beam after entry of said incoming beam through said entry port, and facing to emit electrons indicative of said beam in a direction away from a bottom wall.

* * * * *